US012588744B2

(12) United States Patent
Zhou

(10) Patent No.: US 12,588,744 B2
(45) Date of Patent: Mar. 31, 2026

(54) HAIRDRESSING AND STYLING APPARATUS

(71) Applicant: Shenzhen Fenda Technology Co., Ltd., Shenzhen (CN)

(72) Inventor: Desheng Zhou, Shenzhen (CN)

(73) Assignee: Shenzhen Fenda Technology Co., Ltd., Shenzhen (CN)

( * ) Notice: Subject to any disclaimer, the term of this patent is extended or adjusted under 35 U.S.C. 154(b) by 142 days.

(21) Appl. No.: 18/602,375

(22) Filed: Mar. 12, 2024

(65) Prior Publication Data

US 2025/0040676 A1 Feb. 6, 2025

Related U.S. Application Data

(63) Continuation of application No. PCT/CN2023/127784, filed on Oct. 30, 2023.

(30) Foreign Application Priority Data

Aug. 2, 2023 (CN) ..... 202310972465.2

(51) Int. Cl.
*A45D 2/00* (2006.01)
*A45D 2/36* (2006.01)

(52) U.S. Cl.
CPC ..... *A45D 2/001* (2013.01); *A45D 2/367* (2013.01)

(58) Field of Classification Search
CPC ... A45D 1/00; A45D 1/02; A45D 1/04; A45D 1/06; A45D 1/08; A45D 1/14; A45D 1/18;

(Continued)

(56) References Cited

U.S. PATENT DOCUMENTS 5,868,146 A * 2/1999 Henninger ..... A45D 1/04 132/232
2008/0173322 A1* 7/2008 Leung ..... A45D 2/001 132/229

(Continued)

FOREIGN PATENT DOCUMENTS

CN 205082857 U * 3/2016
CN 217446934 U * 9/2022

OTHER PUBLICATIONS

CN217446934U. Translation. (Year: 2022).*
CN205082857U. Translation (Year: 2016).*

*Primary Examiner* — Rachel R Steitz
*Assistant Examiner* — Karim Asqiriba
(74) *Attorney, Agent, or Firm* — Hemisphere Law, PLLC

(57) ABSTRACT

Disclosed in the present disclosure is a hairdressing and styling apparatus. The hairdressing and styling apparatus include clamping plates, at least a first heating element, and at least a second heating element, where the clamping plates include the first clamping plate and the second clamping plate capable of being opened or closed relative to each other; the first heating element is rotationally arranged on the clamping plate, each of the first heating elements is provided with at least two different styling surfaces, the first heating element can be rotated to at least two different angular positions, such that the different first styling surfaces can be switched for styling; and the second heating element is telescopically arranged on the clamping plate between a first position and a second position.

6 Claims, 7 Drawing Sheets

(58) Field of Classification Search
CPC . A45D 1/28; A45D 2/001; A45D 2/40; A45D 2/367
See application file for complete search history.

(56) References Cited

U.S. PATENT DOCUMENTS

| | | | | |
|---|---|---|---|---|
| 2009/0032048 | A1* | 2/2009 | Suzuki | A45D 2/001 132/227 |
| 2010/0083978 | A1* | 4/2010 | Hottenrott | A45D 1/06 132/211 |
| 2010/0132733 | A1* | 6/2010 | Kyu | A45D 2/36 132/229 |
| 2011/0100391 | A1* | 5/2011 | Paolacci | A45D 2/001 132/226 |
| 2014/0261524 | A1* | 9/2014 | Smith | A45D 1/04 132/211 |
| 2015/0237983 | A1* | 8/2015 | Kock | A45D 2/001 132/229 |
| 2016/0286928 | A1* | 10/2016 | Weatherly | A45D 1/28 |
| 2017/0231350 | A1* | 8/2017 | Moore | A45D 2/001 132/224 |
| 2019/0045901 | A1* | 2/2019 | Kock | A45D 1/08 |
| 2021/0059375 | A1* | 3/2021 | Ashkenazi | A45D 1/04 |

* cited by examiner

HAIRDRESSING AND STYLING APPARATUS

TECHNICAL FIELD

The present disclosure relates to the technical field of hairdressing and styling, and more particularly relates to a hairdressing and styling apparatus.

BACKGROUND ART

At present, different hair styling devices are required for hair straightening and hair curling, even for different curling sizes. When hair straightening and hair curling operations are required at the same time, at least two different hair styling devices need to be prepared, resulting in high costs and frequent changes of hairstyling devices, thereby affecting the work efficiency.

In summary, how to improve the hairdressing and styling efficiency is an urgent problem to be solved by those skilled in the art at present.

SUMMARY

In view of the foregoing problems, the present disclosure aims to provide a hairdressing and styling apparatus that can achieve a variety of different styling effects, avoid frequent replacement of the hairdressing devices, and improve the efficiency of hairdressing and styling.

In order to achieve the above objective, the present disclosure provides the following technical solution:

a hairdressing and styling apparatus, including clamping plates, including a first clamping plate and a second clamping plate in hinged connection, where the first clamping plate and the second clamping plate are capable of being opened or closed relative to each other;

at least one first heating element capable of being rotationally arranged on the clamping plate, where each first heating element is provided with at least two different first styling surfaces, and the first heating element can be rotated to at least two different angular positions, such that the different first styling surfaces can be switched for styling; and at least a second heating element, where the second heating element is telescopically arranged on the clamping plate between a first position and a second position, and a direction of extension and retraction of the second heating element has a component perpendicular to the clamping plate on which it is located.

Optionally, the first clamping plate is provided with the first heating element, and the second clamping plate is provided with the second heating element; and an accommodating cavity for accommodating the second heating element extending is formed on the first clamping plate.

Optionally, the accommodating cavity is located on one side of the first heating element.

Optionally, the first styling surface includes a first heating plane and a first heating arc surface, the third heating element is fixedly mounted on at least one of the first clamping plate and the second clamping plate, the third heating element is located on one side of the second heating element or an inner side of the first heating element, and the third heating element is provided with a second heating plane.

Optionally, the second clamping plate is provided with the third heating element; and the second heating element is provided with a second heating arc surface;

when the second heating element is at the first position, a highest point of the second heating element is lower than or flush with the second heating plane, and the first clamping plate and the second clamping plate are in a clamping state, such that the first heating plane cooperates with the second heating plane to clamp the hair; and when the second heating element is at the second position, the highest point of the second heating element is higher than the second heating plane, the first clamping plate and the second clamping plate are in a clamping state, the hair is wound around the second heating arc surface and the first heating arc surface, and the first heating arc surface cooperates with the second heating plane to fix the hair.

Optionally, the first clamping plate is provided with two first heating elements, and the accommodating cavity is located between the two first heating elements; and two third heating elements are fixedly mounted on the second clamping plate, and the second heating element is located between the two third heating elements.

Optionally, the first heating plane has an extending portion towards the accommodating cavity, and the extending portion is overlapped with the second heating element in an extension direction of the extending portion; and when the second heating element moves from the first position to the second position, the extending portion is pushed to make the first heating element rotated.

Optionally, the first clamping plate is provided with a limiting protrusion, where the limiting protrusion is configured for limiting a rotation direction of the first heating element.

Optionally, at least one of the first clamping plate and the second clamping plate are provided with both the first heating element and the second heating element.

Optionally, the hairdressing and styling apparatus further includes a first driving assembly and a second driving assembly, where the first driving assembly is configured for driving the first heating element to rotate, and the second driving assembly is configured for driving the second heating element to move.

When the hairdressing and styling apparatus provided by the present disclosure is used, different first styling surfaces can be switched by rotating the first heating element to different angular positions, and an extending length of the second heating element can be adjusted by controlling a position of extension and retraction of the second heating element, such that hair styling effects are adjusted, a variety of different styling effects are achieved, frequent replacement of the hairdressing devices is avoided, and the efficiency of hairdressing and styling is improved.

BRIEF DESCRIPTION OF THE DRAWINGS

In order to more clearly illustrate the technical solution in embodiments of the present disclosure or in the prior art, a brief introduction to the accompanying drawings required for the description of the embodiments or the prior art will be provided below. Obviously, the accompanying drawings in the following specification are merely embodiments of the present disclosure. Those of ordinary skill in the art would also derive other accompanying drawings from these accompanying drawings without making inventive efforts.

In FIGS. 1A-10:

Figure 1A:
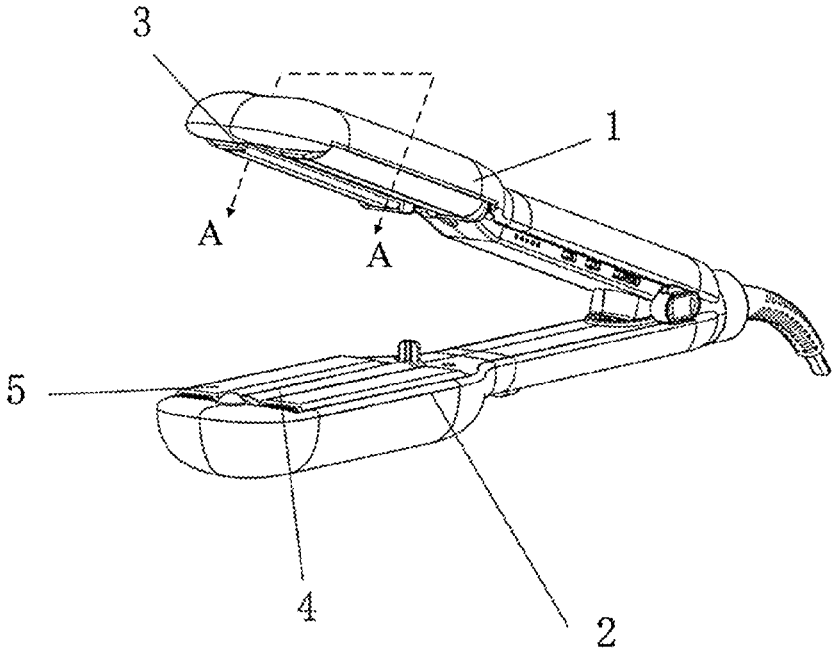
FIG. 1A is a structural schematic diagram of a specific embodiment of a hairdressing and styling apparatus provided by the present disclosure.
Figure 1B:
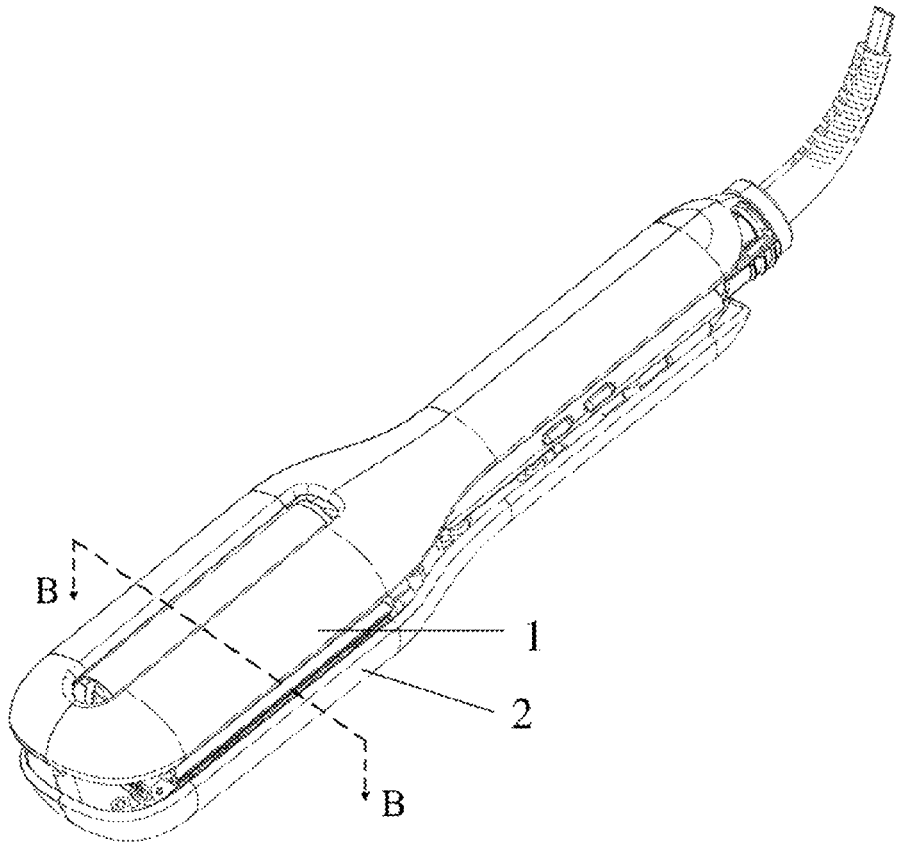
FIG. 1B illustrates a schematic diagram of the hairdressing and styling apparatus in a closed state provided by the disclosure.
Figure 2:
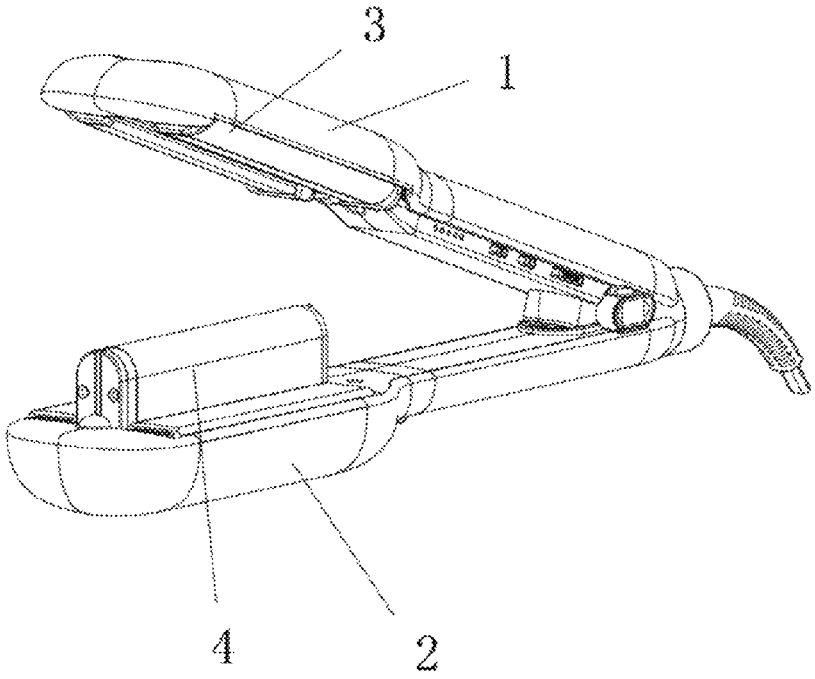
FIG. 2 is a structural schematic diagram when a second heating element of the hairdressing and styling apparatus in FIG. 1A moves to a second position.

1. first clamping plate; 11. accommodating cavity; 12. limiting protrusion; 2. second clamping plate; 3. first heating element; 31. first heating plane; 311. extending portion; 32. first heating arc surface; 33. third heating plane; 4. second heating element; 41. second heating arc surface; 5. third heating element; 51. second heating plane; and 6. spring.

DETAILED DESCRIPTION OF THE EMBODIMENTS

The technical solutions of embodiments of the present disclosure will be described below clearly and comprehensively in conjunction with accompanying drawings of the embodiments of the present disclosure. Apparently, the embodiments described are merely some embodiments rather than all embodiments of the present disclosure. All the other embodiments obtained by those of ordinary skill in the art based on the embodiments in the present disclosure without creative efforts shall fall within the protection scope of the present disclosure.

The present disclosure aims to provide a hairdressing and styling apparatus that can achieve a variety of different styling effects, avoid frequent replacement of the hairdressing devices, and improve the efficiency of hairdressing and styling.

Embodiment 1

With reference to FIGS. 1A-10, this specific embodiment discloses a hairdressing and styling apparatus, including clamping plates, at least one first heating element 3, and at least a second heating element 4, where the clamping plates include a first clamping plate 1 and a second clamping plate 2, and the first clamping plate 1 and the second clamping plate 2 are capable of being opened or closed relative to each other; the first heating element 3 is rotationally arranged on the clamping plate, each first heating element 3 is provided with at least two different first styling surfaces, and the first heating element 3 can be rotated to at least two different angular positions, such that the different first styling surfaces can be switched for styling; and the second heating element 4 is telescopically arranged on the clamping plate between a first position and a second position, and a direction of extension and retraction of the second heating element 4 has a component perpendicular to its clamping plate.

Preferably, the direction of extension and retraction of the second heating element 4 is perpendicular to the clamping plate on which it is located.

It should be noted that the first heating element 3 in the hairdressing and styling apparatus provided in this specific embodiment can be arranged on the first clamping plate 1, the second heating element 4 can be arranged on the second clamping plate 2, or the first heating element 3 and the second heating element 4 can be both arranged on the first clamping plate 1 or the second clamping plate 2, which will be determined based on actual situations and will not be described in detail herein.

The different first styling surfaces on the first heating element 3 can be heating planes, heating arc surfaces, rectangular convex surfaces, trapezoidal convex surfaces, and the like.

The second heating element 4 can be extended to the second position, or retracted to the first position, and can also stay at any position between the first position and the second position.

When the hairdressing and styling apparatus provided in this specific embodiment is used, different first styling surfaces can be switched by rotating the first heating element 3 to different angular positions, and an extending length of the second heating element can be adjusted by controlling a position of extension and retraction of the second heating element 4, such that hair styling effects are adjusted, a variety of different styling effects are achieved, frequent replacement of the hairdressing devices is avoided, and the efficiency of hairdressing and styling is improved.

In one specific embodiment, the first clamping plate 1 is provided with the first heating element 3, the second clamping plate 2 is provided with the second heating element 4, and an accommodating cavity 11 for accommodating the second heating element extending 4 is formed on the first clamping plate 1.

In this specific embodiment, the accommodating cavity 11 can be formed on the first heating element 3 or at one side of the first heating element 3; when the accommodating cavity 11 is formed on the first heating element 3, the first heating element 3 and the second heating element 4 are arranged opposite each other; and when the first heating element is at the second position, the accommodating cavity 11 is arranged towards the second heating element 4, and the second heating element 4 can enter the accommodating cavity 11 when being extended to the second position, such that hair is clamped between a first heating arc surface 32 and the second heating element 4 for hair curling styling.

Embodiment 2

Figure 9:
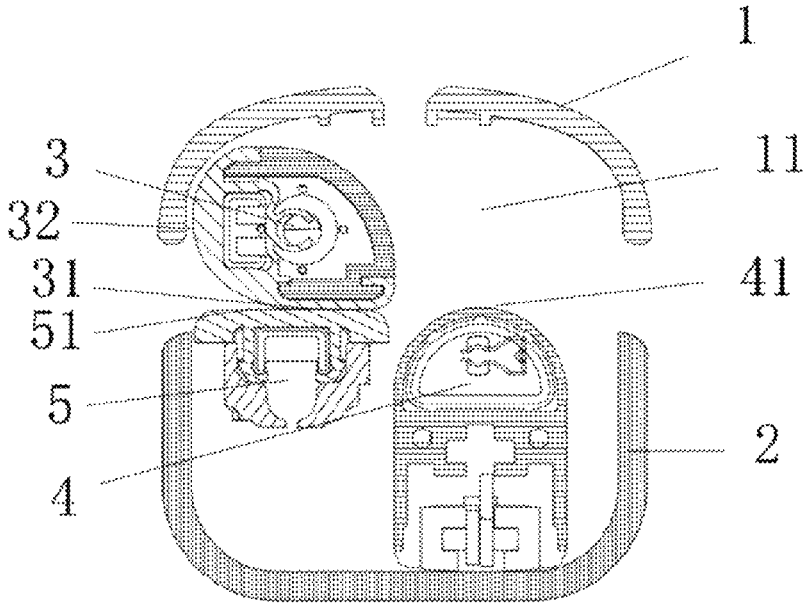
FIG. 9 is a schematic sectional view taken along a line B-B illustrated in FIG. 1B in which a second heating element in a hairdressing and styling apparatus provided by the present disclosure retracts to a first position.

As shown in FIG. 9, the first heating element 3 is arranged on the first clamping plate 1, the second heating element 4 is arranged on the second clamping plate 2, the accommodating cavity 11 is formed on the first clamping plate 1 at a position corresponding to the second heating element 4, and the first heating element 3 and the second heating element 4 are arranged in a staggered manner, such that the second heating element 4 can extend into the accommodating cavity 11.

Figure 10:
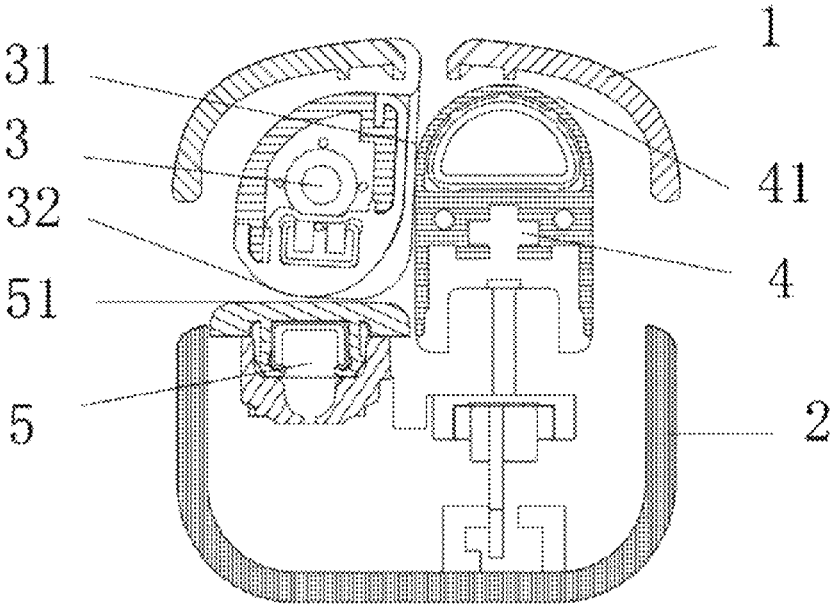
FIG. 10 is a schematic sectional view taken along a line B-B illustrated in FIG. 1B in which a second heating element in a hairdressing and styling apparatus provided by the present disclosure retracts to a second position.

In FIG. 9, the accommodating cavity 11 is located on one side of the first heating element 3, and in FIG. 10, a third heating element 5 is arranged on one side of the second heating element 4, the third heating element 5 has a second heating plane 51, the second heating element 4 has a second styling surface, and the second styling surface includes a second heating arc surface 41; when the second heating element 4 is at the first position, as shown in FIG. 9, the first clamping plate 1 is closed relative to the second clamping plate 2, and a first heating plane 31 of the first heating element 3 cooperates with the second heating plane 51 of the third heating element 5 to clamp the hair and be used for straight hair styling; and when the second heating element 4 is at the second position, as shown in FIG. 10, the first clamping plate 1 is closed relative to the second clamping plate 2, the first heating arc surface 32 of the first heating element 3 faces the second heating plane 51 of the third heating element 5, the hair is wound around the first heating arc surface 32 and the second heating arc surface 41 for curling hair styling when the hairdressing and styling apparatus is used.

In this specific embodiment, a size of hair curls in the hair curling styling can be adjusted by adjusting an extending distance of the second heating element 4, such that the styling effect can be adjusted.

On the basis of the above embodiment, the second heating element 4 can also be arranged at an upper position of the accommodating cavity 11 on the first clamping plate 1 in FIG. 9, the second heating element 4 is provided with a third heating arc surface for cooperating with the second heating arc surface 41 of the second heating element 4 on the second clamping plate 2, extension and retraction of the second heating element 4 on the first clamping plate 1 is adjusted when extension and retraction of the second heating element 4 on the second clamping plate 2 is adjusted, such that the two oppositely arranged second heating elements 4 cooperate with each other to clamp the hair.

In another embodiment, the first styling surface includes the first heating plane 31 and the first heating arc surface 32, the third heating element 5 is fixedly mounted on at least one of the first clamping plate 1 and the second clamping plate 2, the third heating element 5 is located on one side of the second heating element 4 or an inner side of the first heating element 3, and the third heating element 5 is provided with the second heating plane 51.

Figure 6:
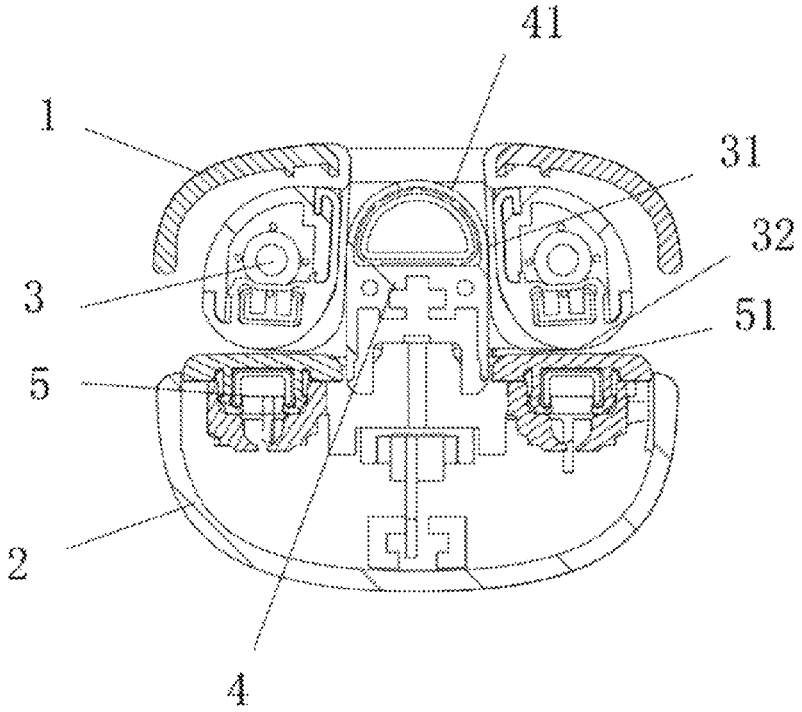
FIG. 6 is a schematic sectional view taken along a line B-B illustrated in FIG. 1B in which a second heating element in a hairdressing and styling apparatus provided by the present disclosure extends to a second position.
Figure 8:
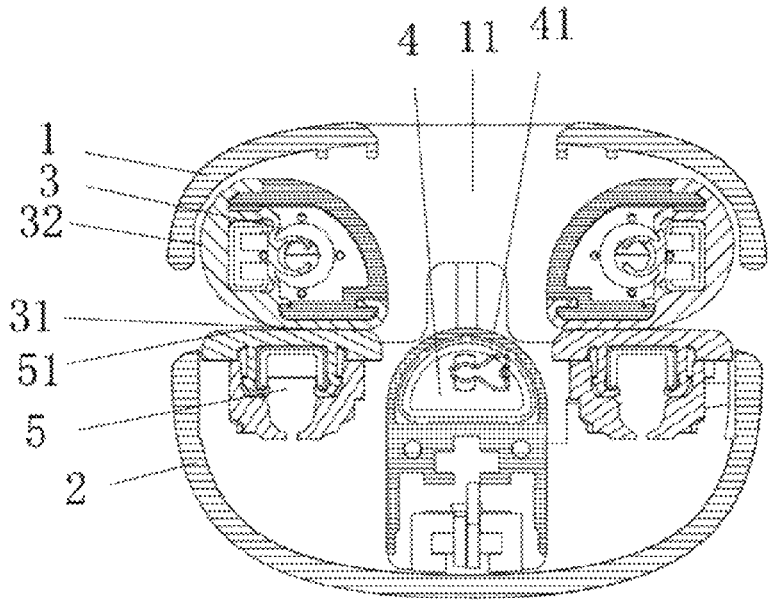
FIG. 8 is a schematic sectional view taken along a line B-B illustrated in FIG. 1B in which a second heating element in a hairdressing and styling apparatus provided by the present disclosure retracts to a first position.

As shown in FIG. 8, the second clamping plate 2 is provided with the third heating element 5; the second heating element 4 is provided with the second heating arc surface 41; when the second heating element 4 is at the first position, a highest point of the second heating element 4 is lower than or flush with the second heating plane 51, and the first clamping plate 1 and the second clamping plate 2 are in a clamping state, such that the first heating plane 31 cooperates with the second heating plane 51 to clamp the hair; and when the second heating element 4 is at the second position, as shown in FIG. 6, the highest point of the second heating element 4 is higher than the second heating plane 51, the first clamping plate 1 and the second clamping plate 2 are in a clamping state, the hair is wound around the second heating arc surface 41 and the first heating arc surface 32, and the first heating arc surface 32 cooperates with the second heating plane 51 to fix the hair.

As shown in FIG. 6, the first clamping plate 1 is provided with two first heating elements 3, and the accommodating cavity 11 is located between the two first heating elements 3; and two third heating elements 5 are fixedly mounted on the second clamping plate 2, and the second heating element 4 is located between the two third heating elements 5. Alternatively, as shown in FIG. 9, the first clamping plate 1 is provided with the first heating element 3, and the accommodating cavity 11 is located at one side of the first heating element 3.

Figure 7:
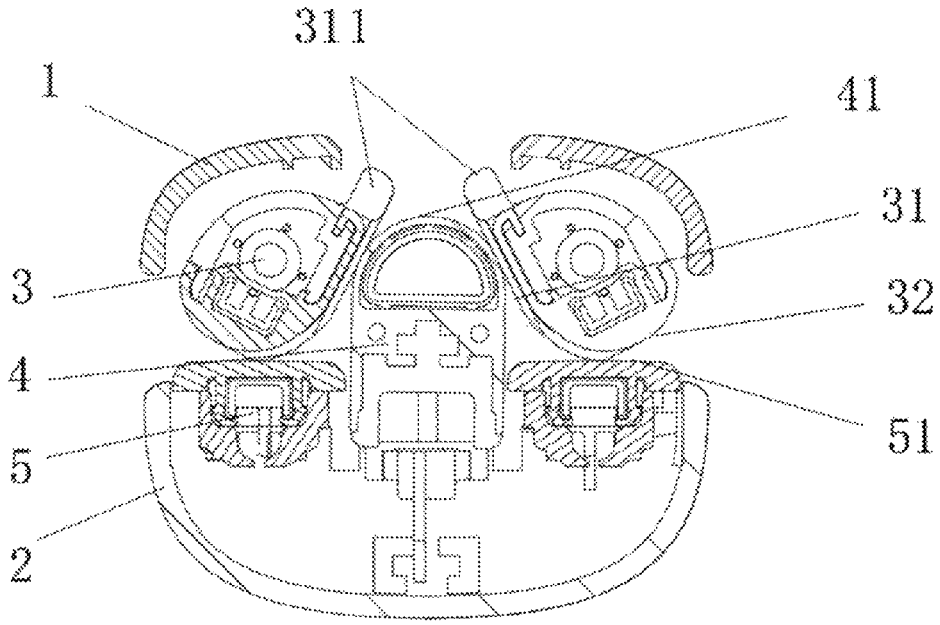
FIG. 7 is a schematic sectional view taken along a line B-B illustrated in FIG. 1B in which a second heating element extending from a first position to a second position of a hairdressing and styling apparatus provided by the present disclosure.

As shown in FIGS. 6-8, the first heating plane 31 has an extending portion 311 towards the accommodating cavity 11, and the extending portion 311 is overlapped with the second heating element 4 in an extension direction of the extending portion 311; and when the second heating element 4 moves from the first position to the second position, the extending portion 311 is pushed to make the first heating element 3 rotated.

As shown in FIG. 7, when the second heating element 4 moves from the first position to the second position, the first heating element 3 is pushed to rotate; and when the second heating element 4 moves to the second position, as shown in FIG. 6, the first heating element 3 just rotates to a position where the first heating arc surface 32 and the second heating plane 51 are opposite.

As shown in FIG. 8, the second heating element 4 is at the first position, the first heating plane 31 of the first heating element 3 cooperates with the second heating plane 51 of the third heating element 5 to clamp the hair and be used for straight hair styling when the hairdressing and styling apparatus is used; as shown in FIG. 7, during the process when the second heating element 4 moves from the first position to the second position, the extending length of the second heating element 4 continues to increase, and the first heating element 3 is pushed to rotate; when the second heating element 4 stays at any position between the first position and the second position, the first clamping plate 1 is closed relative to the second clamping plate 2, the hair is wound around the second heating arc surface 41 and the first heating arc surface 32 of the first heating element 3, such that the hair curling styling can be achieved; when the second heating element 4 moves to the second position, as shown in FIG. 6, the second heating element 4 extends into the accommodating cavity 11 of the first clamping plate 1 and pushes the extending portion 311 to rotate, such that the first heating element 3 rotates to a position where the first heating arc surface 32 corresponds to the second heating plane 51 of the second clamping plate 2; and when the first clamping plate 1 is closed relative to the second clamping plate 2, the hair is wound around the second heating arc surface 41, and is clamped and fixed by the first heating arc surface 32 and the second heating plane 51, such that the hair curling styling can be achieved.

It should be noted that the second heating element 4 in this specific embodiment can stay at any position between the first position and the second position, as shown in FIG. 7, when the second heating element 4 stays at a position between the first position and the second position, the hair is wound around the portion where the second heating arc surface 41, the first heating plane 31 and the first heating arc surface 32 are connected; when the extending length of the second heating element 4 changes, a size of the second heating arc surface 41 in contact with the hair, and a portion of the connection between the first heating plane 31 and the first heating arc surface 32 that is in contact with the hair change accordingly, such that curl and size of the styling are changed, resulting in different styling effects.

To sum up, when second heating element 4 stays at any position between the first position and the second position, a new styling effect will be produced, and the extending length of the second heating element 4 can be adjusted between the first position and the second position, such that different styling effects can be achieved.

Specifically, the extending portion 311 can be configured as a heat conductive member, and the lower surface of the extending portion 311 is planar and flush with the first heating plane 31; the second clamping plate 2 is provided with a fourth heating element, the fourth heating element is provided with a third heating plane for cooperating with the lower surface of the extending portion 311, and the fourth heating element can be foldable and arranged on the third heating element 5; when the second heating element 4 is at the first position, the third heating plane of the fourth heating element cooperates with the lower surface of the extending portion 311 to clamp the hair; and when the second heating element 4 is extended from the first position to the second position, the second heating element pushes the fourth heating element, such that the fourth heating element is folded upwards relative to the third heating element.

In this specific embodiment, by configuring the extending portion 311 as the heat conductive member and providing the fourth heating element in cooperation with the lower surface of the extending portion 311, a heating area is increased and the hair straightening styling effect is improved when hair straightening styling is performed.

It should be noted that the second heating element 4 can be arranged at an upper position of the accommodating cavity 11 in FIG. 8, the second heating element 4 is provided with a third heating arc surface for cooperating with the second heating arc surface 41 of the second heating element 4 on the second clamping plate 2, extension and retraction of the second heating element 4 on the first clamping plate 1 is adjusted when extension and retraction of the second heating element 4 on the second clamping plate 2 is adjusted, such that the two oppositely arranged second heating elements 4 cooperate with each other to clamp the hair.

It should be noted that the first clamping plate 1 or the second clamping plate 2 can be provided with the first heating element 3, the second heating element 4 and the third heating element 5 at the same time, or can be provided with a plurality of first heating elements 3 or a plurality of second heating elements 4 or a plurality of third heating elements 5 at the same time, which will be determined based on actual situations and will not be described in detail herein.

Figure 4:
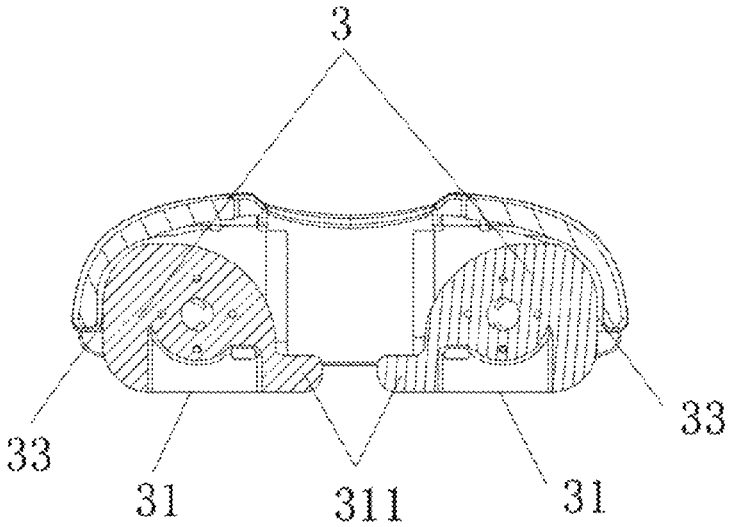
FIG. 4 is a schematic sectional view taken along a line A-A illustrated in FIG. 1A showing a first clamping plate and components on the first clamping plate of a hairdressing and styling apparatus provided by the present disclosure.
Figure 5:
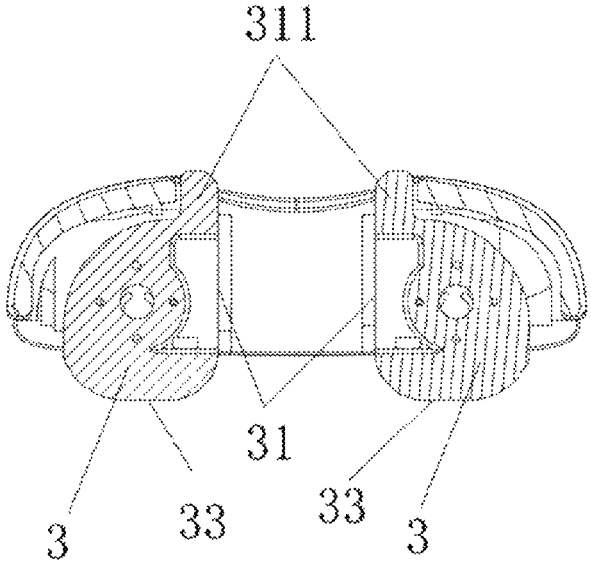
FIG. 5 is a schematic sectional view taken along the line A-A illustrated in FIG. 1A when a first heating element is located at another angular position.

In a specific embodiment, as shown in FIGS. 4 and 5, the first heating element 3 is provided with the first heating plane 31 and the third heating plane 33; when the first heating element 3 is at the angular position as shown in FIG. 4, the first heating plane 31 faces the second clamping plate 2 for cooperating with the heating element in the second clamping plate 2 to clamp the hair; and when the first heating element 3 is at the angular position shown in FIG. 5, the third heating plane 33 faces the second clamping plate 2 for cooperating with the heating element in the second clamping plate 2 to clamp the hair.

In this specific embodiment, the first heating element 3 is provided with the first heating plane 31 and the third heating plane 33, such that straight hair styling or other styling effects can be achieved. Of course, the first styling surface in the first heating element 3 can also be other shapes.

Figure 3:
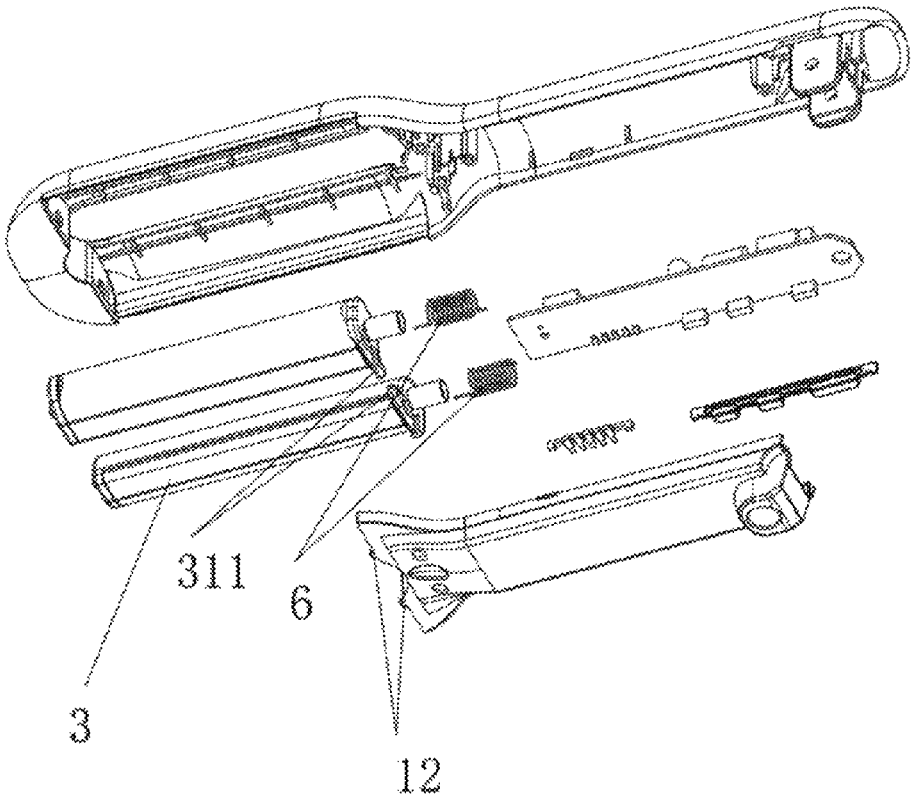
FIG. 3 is an exploded view of a first clamping plate in FIG. 1A and components mounted on the first clamping plate.

In a specific embodiment, as shown in FIG. 3, the first clamping plate 1 is provided with a limiting protrusion 12, where the limiting protrusion 12 is configured for limiting a rotation direction of the first heating element 3; specifically, when the first heating element 3 is at the position as shown in FIG. 4, the limiting protrusion 12 is in contact with the first heating element 3, such that the first heating element 3 can only be rotated counterclockwise to the angle as shown in FIG. 5 based on the angular position as shown in FIG. 4, but and cannot be rotated clockwise based on the angular position as shown in FIG. 4, so as to limit the rotation direction of the first heating element 3.

Further, as shown in FIG. 3, one side of the first heating element 3 is butted against one end of a spring 6, and the other end of the spring 6 is butted against the first clamping plate 1 when the first heating element is installed, so as to facilitate the installation of the first heating element 3.

Further, a boss can be arranged on the third heating element 5, the boss is configured for carrying the fourth heating element that cooperates with the extending portion 311 to clamp the hair, such that the fourth heating element can cooperate with the lower surface of the extending portion 311 to clamp the hair. It should be noted that the arrangement of the boss cannot affect the extension of the second heating element 4.

On the basis of the above embodiment, the hairdressing and styling apparatus further includes a first driving assembly and a second driving assembly, where the first driving assembly is configured for driving the first heating element 3 to rotate, and the second driving assembly is configured for driving the second heating element 4 to move.

Both the first driving assembly and the second driving assembly can be a combination of a power component and a transmission structure, which will be determined based on actual situations and will not be described in detail herein.

Of course, the first heating element 3 and the second heating element 4 can also be provided with protrusions for facilitating manual rotation, so as to achieve manual rotation of the first heating element 3 or manual movement of the second heating element 4, which will be determined based on actual situations and will not be described in detail herein.

Each embodiment of the specification is described in a progressive manner, each embodiment focuses on differences from other embodiments, and the same and similar parts between the embodiments may refer to each other. Any combination of all the embodiments provided by the present disclosure falls within the scope of protection of the present disclosure, and will not be described in detail herein.

The hairdressing and styling apparatus provided by the present disclosure has been described in detail above. Specific embodiments are used for illustrating principles and implementations of the disclosure herein. The description of the embodiments above is only used for helping understand the method and its core concept of the disclosure. It should be pointed out that those ordinarily skilled in the art may also make some improvements and modifications without departing from the principle of the present disclosure, and these improvements and modifications should also fall within the scope of protection of the present disclosure.

What is claimed is:

1. A hairdressing and styling apparatus, comprising:

clamping plates, comprising a first clamping plate (1) and a second clamping plate (2) in hinged connection, wherein the first clamping plate (1) and the second clamping plate (2) are capable of being opened or closed relative to each other;

at least one first heating element (3) capable of being rotationally arranged on the first clamping plate (1), wherein each of the at least one first heating element (3) is provided with at least two different first styling surfaces, and the at least one first heating element (3) is rotatable to at least two different angular positions, such that the at least two different first styling surfaces are switchable for styling; and at least one second heating element (4), wherein the at least one second heating element is telescopically arranged on the second clamping plate (2) between a first position and a second position, and a direction of extension and retraction of the at least one second heating element (4) has a component perpendicular to the second clamping plate (2) on which it is located;

wherein the first clamping plate (1) is provided with the at least one first heating element (3), and the second clamping plate (2) is provided with the at least one second heating element (4); and an accommodating cavity (11) for accommodating the at least one second heating element extending (4) is formed on the first clamping plate (1);

wherein the accommodating cavity (11) is located on one side of the at least one first heating element (3);

wherein each of the at least two different first styling surfaces comprises a first heating plane (31) and a first heating arc surface (32), a third heating element (5) is fixedly mounted on at least one of the first clamping plate (1) and the second clamping plate (2), the third heating element (5) is located on one side of the at least one second heating element (4) or an inner side of the at least one first heating element (3), and the third heating element (5) is provided with a second heating plane (51).

2. The hairdressing and styling apparatus according to claim 1, wherein the second clamping plate (2) is provided with the third heating element (5); and the at least one second heating element (4) is provided with a second heating arc surface (41);

when the at least one second heating element (4) is at the first position, a highest point of the at least one second heating element (4) is lower than or flush with the second heating plane (51), and the first clamping plate (1) and the second clamping plate (2) are in a clamping state, such that the first heating plane (31) cooperates with the second heating plane (51) to clamp hair; and when the at least one second heating element (4) is at the second position, the highest point of the at least one second heating element (4) is higher than the second heating plane (51), the first clamping plate (1) and the second clamping plate (2) are in a clamping state, the hair is wound around the second heating arc surface (41) and the first heating arc surface (32), such that the first heating arc surface (32) cooperates with the second heating plane (51) to fix the hair.

3. The hairdressing and styling apparatus according to claim 1, wherein the first clamping plate (1) is provided with two first heating elements (3), and the accommodating cavity (11) is located between the two first heating elements (3); and two third heating elements (5) are fixedly mounted on the second clamping plate (2), and the at least one second heating element (4) is located between the two third heating elements (5).

4. The hairdressing and styling apparatus according to claim 1, wherein the first heating plane (31) has an extending portion (311) towards the accommodating cavity (11), and the extending portion (311) is overlapped with the at least one second heating element (4) in an extension direction of the extending portion (311); and when the at least one second heating element (4) moves from the first position to the second position, the extending portion (311) is pushed to make the at least one first heating element (3) rotated.

5. The hairdressing and styling apparatus according to claim 4, wherein the first clamping plate (1) is provided with a limiting protrusion (12), wherein the limiting protrusion (12) is configured for limiting a rotation direction of the at least one first heating element (3).

6. The hairdressing and styling apparatus according to claim 1, wherein at least one of the first clamping plate (1) and the second clamping plate (2) are provided with both the at least one first heating element (3) and the at least one second heating element (4).

* * * * *